US005354109A

United States Patent [19]

Lin

[11] Patent Number: 5,354,109

[45] Date of Patent: Oct. 11, 1994

[54] DEAD BOLT ASSEMBLY FOR TUBULAR DOOR LOCKS

[76] Inventor: Jui-Chang Lin, No. 55-10, Been-Chou Rd., Kangshan, Kaohsiung Hsien, Taiwan

[21] Appl. No.: 105,969

[22] Filed: Aug. 13, 1993

Related U.S. Application Data

[63] Continuation-in-part of Ser. No. 980,976, Nov. 24, 1992, Pat. No. 5,257,838.

[51] Int. Cl.[5] ..... E05C 1/16

[52] U.S. Cl. ..... 292/1.5; 292/169.14

[58] Field of Search ..... 292/1.5, DIG. 61, 337, 292/169.14, 17, DIG. 60, 152

[56] References Cited

U.S. PATENT DOCUMENTS

| | | | |
|---|---|---|---|
| 663,503 | 12/1900 | Laureyns | 292/1.5 X |
| 4,639,025 | 1/1987 | Fann et al. | 292/337 |
| 4,804,216 | 2/1989 | Marotto | 292/337 |
| 4,850,626 | 7/1989 | Gallego | 292/337 |
| 4,890,871 | 1/1990 | Lin | 292/1.5 X |
| 4,927,195 | 5/1990 | Wu et al. | 292/169.14 |
| 4,927,199 | 5/1990 | Wu et al. | 292/1.5 |
| 4,976,122 | 12/1990 | Doolan et al. | 292/1.5 X |
| 5,002,319 | 3/1991 | Chandler | 292/17 |
| 5,169,184 | 12/1992 | Bishop | 292/1.5 |
| 5,257,838 | 11/1993 | Lin | 292/1.5 |

*Primary Examiner*—Rodney M. Lindsey

*Attorney, Agent, or Firm*—Jacobson, Price, Holman & Stern

[57] ABSTRACT

A door lock includes a dead bolt slidably received in a cylinder and including a pair of extensions extended outward beyond the cylinder, a pair of plates fixed to the cylinder, an oblong hole formed in each of the plates, an actuating wheel slidably engaged in the oblong holes of the plates and including a pair of teeth for engagement with the protrusions of the extensions when the actuating wheel rotates. A resilient member is fixed to one of the plates for positioning the actuating wheel.

8 Claims, 6 Drawing Sheets

DEAD BOLT ASSEMBLY FOR TUBULAR DOOR LOCKS

CROSS REFERENCE TO RELATED APPLICATION

This application is a Continuation-in-Part of application Ser. No. 980,976 filed Nov. 24, 1992, and now U.S. Pat. No. 5,257,838, the contents of which is incorporated herein by reference.

BACKGROUND OF THE INVENTION

1. Field of the Invention

The present invention relates to a dead bolt assembly, and more particularly to a dead bolt assembly for a tubular door lock.

2. Description of the Prior Art

Various kinds of tubular door locks have been developed and widely used, some of which are disclosed in the following U.S. Pat. Nos.: 4,639,025 to Fann et al., filed Mar. 17, 1986, entitled "ADJUSTABLE DEAD BOLT ASSEMBLY"; 4,804,216 to Marotto, filed Feb. 1, 1988, entitled "CONVERTIBLE BACKSET LATCH MECHANISM"; 4,850,626 to Gallego, filed Mar. 2, 1988, entitled "IMPROVED LATCH BOLT WITH SELECTIVELY VARIABLE DRIVING PIN DEPTH"; 4,890,871 to Lin, filed Nov. 17, 1988, entitled "TUBULAR DOOR LOCK WITH AN ADJUSTABLE DEVICE FOR SETTING THE DEAD BOLT"; 4,927,195 to Wu et al., filed Nov. 8, 1988, entitled "DUAL BACKSET DEADBOLT ASSEMBLY"; and 4,927,199 to Wu et al., filed Sep. 23, 1988, entitled "LATCH ASSEMBLY FOR CYLINDER LOCK". In these patents, the configurations thereof are complicated and can further be simplified such that the manufacturing fees thereof can be decreased.

The present invention has arisen to mitigate and/or obviate the afore-described disadvantages of the conventional tubular door locks.

SUMMARY OF THE INVENTION

The primary objective of the present invention is to provide a dead bolt assembly for a tubular door lock which has a simplified configuration and a reduced manufacturing fee.

In accordance with one aspect of the present invention, there is provided a dead bolt assembly comprising a lock case including a cylinder, a dead bolt slidably received in the cylinder and including a pair of extensions extended outward beyond the cylinder, each of the extensions including a pair of protrusions extended therefrom, a pair of plates fixed to the cylinder and each including an oblong hole formed therein, each of the oblong holes including two end portions, and an actuating wheel slidably engaged in the oblong holes of the plates and slidable between the end portions of the oblong holes and slidable between the extensions of the dead bolt, the actuating wheel including a pair of teeth for engagement with the protrusions of the extensions when the actuating wheel rotates.

Further objectives and advantages of the present invention will become apparent from a careful reading of the detailed description provided hereinbelow, with appropriate reference to the accompanying drawings.

DETAILED DESCRIPTION OF THE INVENTION

Figure 1:
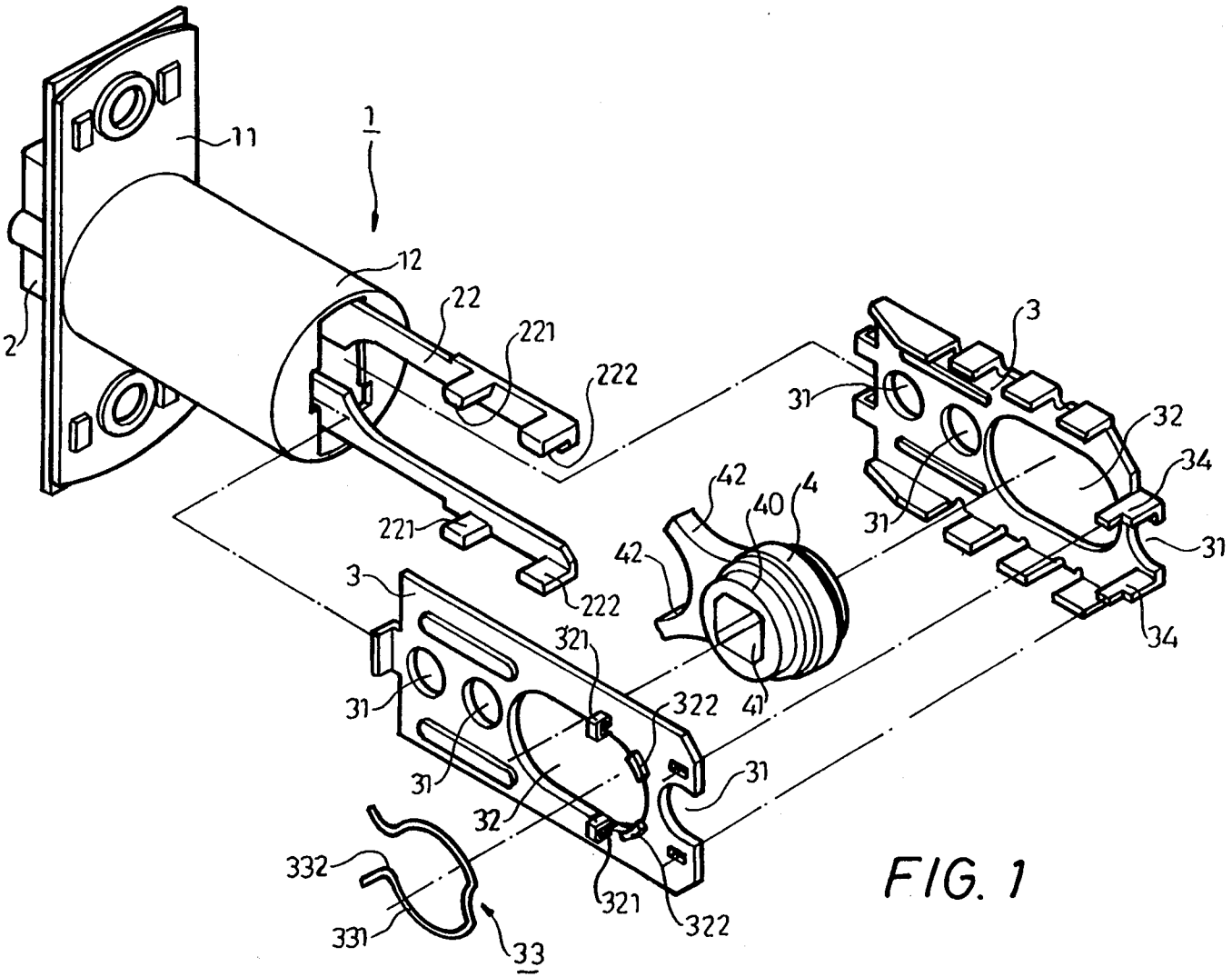
FIG. 1 is an exploded view of a dead bolt assembly for a tubular door lock in accordance with the present invention.
Figure 2:
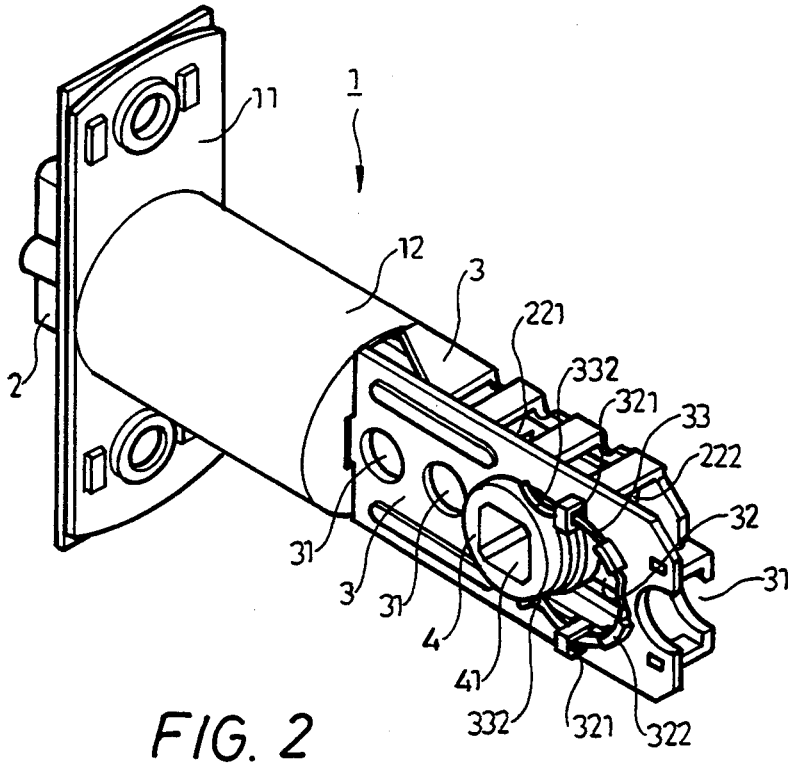
FIGS. 2 and 3 are perspective views illustrating the operations of the dead bolt assembly as shown in FIG. 1.
Figure 3:
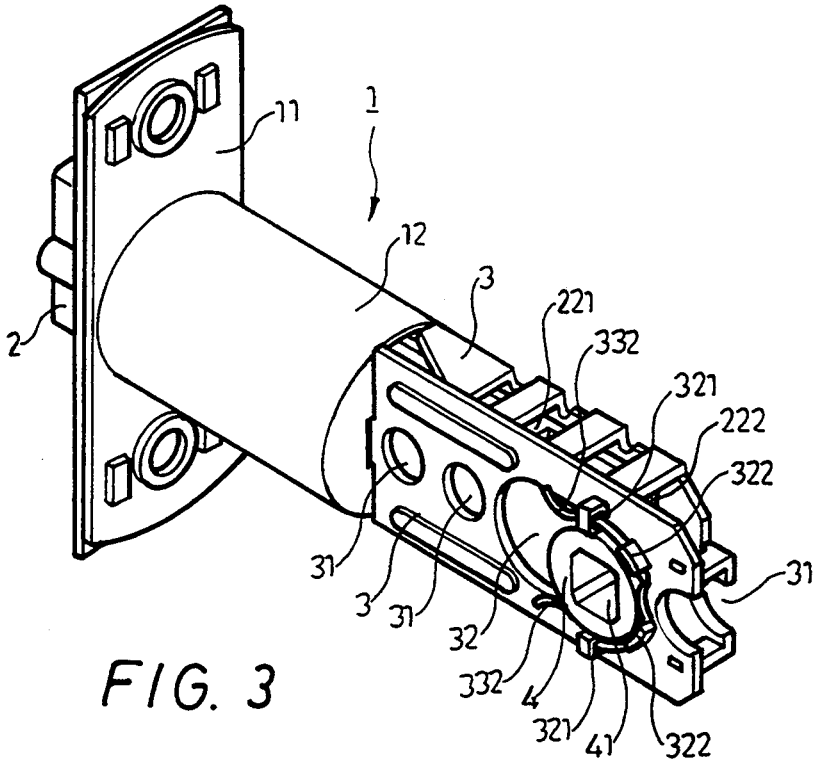

Referring to the drawings and initially to FIGS. 1 to 3, a dead bolt assembly for a tubular door lock in accordance with the present invention comprises generally a lock case 1, a dead bolt 2 accommodated within the lock case 1, a pair of plates 3 coupled to the lock case 1 and an actuating wheel 4 engageable with the dead bolt 2 for operating the dead bolt 2.

The lock case 1 includes a face plate 11 and a cylinder 12 for accommodating the dead bolt 2, the dead bolt 2 including a pair of extensions 22 extended outward through the cylinder 12, each of the extensions 22 including a pair of protrusions 221, 222 extended therefrom. The actuating wheel 4 includes a square hole 41 formed in the center thereof for insertion of the square shaft of the door lock (not shown) so that the actuating wheel 4 can be rotated and includes a pair of teeth 42 for engagement with the protrusions 221, 222 of the extensions 22 when the actuating wheel 4 rotates.

The plates 3 are fixed to the cylinder 12, or otherwise, formed integral with the cylinder 12. Each of the plates 3 includes three openings 31 formed therein for fixing the plates 3 to the door (not shown) such that the plates 3 and the lock case 1 are fixed within the door, and includes an oblong hole 32 formed therein for slidably engagement with a pair of shoulders 40 formed in the side portions of the actuating wheel 4. One of the plates 3 includes a pair of loops or hooks 321 and a pair of stops 322, a resilient member 33 is engaged with and is stably retained in place by the hooks 321 and the stops 322 of the plate 3, the resilient member 33 includes two legs 331 resiliently engaged with the actuating wheel 4 and a throat portion 332 having a distance smaller than the outer diameter of the actuating wheel 4, the throat portion 332 is located in the middle portion of the oblong hole 32 for positioning the actuating wheel 4; i.e., the actuating wheel 4 may move through the throat portion 332 of the resilient member 33 and may move between the end portions of the oblong holes 32 and may be positioned in the end portions of the oblong holes 32 by the throat portion 332 of the resilient member 33.

Figure 5:
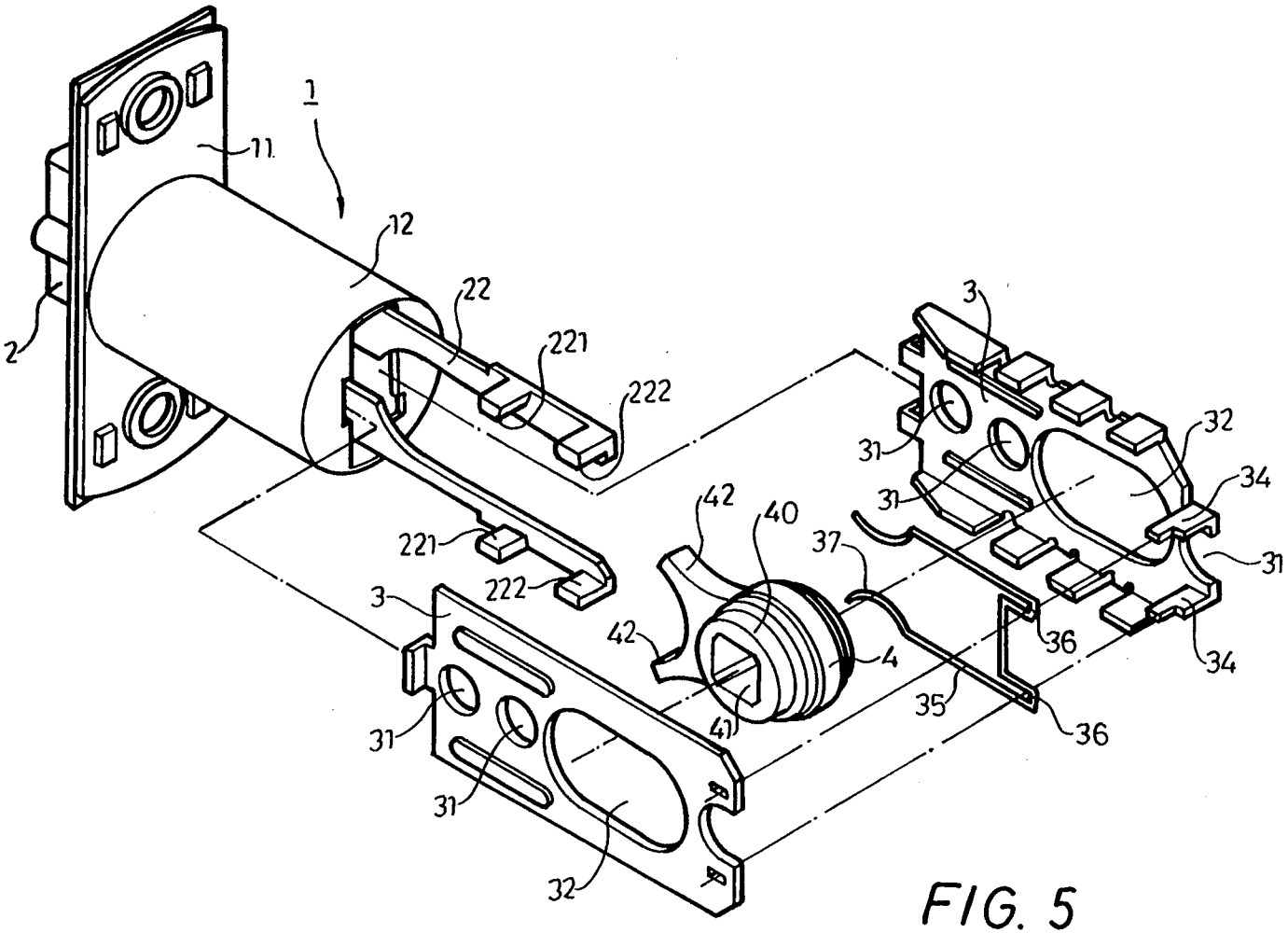
FIG. 5 is an exploded view in accordance with a third embodiment of the present invention.

Referring next to FIG. 5, illustrated is a second embodiment of the present invention which is almost identical to the embodiment as shown in FIGS. 1 to 3, except that two resilient members 33 are used and each fixed to the respective plate 3, and the actuating wheel 4 includes two halves each independently and slidably engaged in the respective oblong holes 32 of the plates 3 and engaged with the resilient members 33 such that the extensions 22 can be actuated by either half of the actuating wheel 4.

Figure 4:
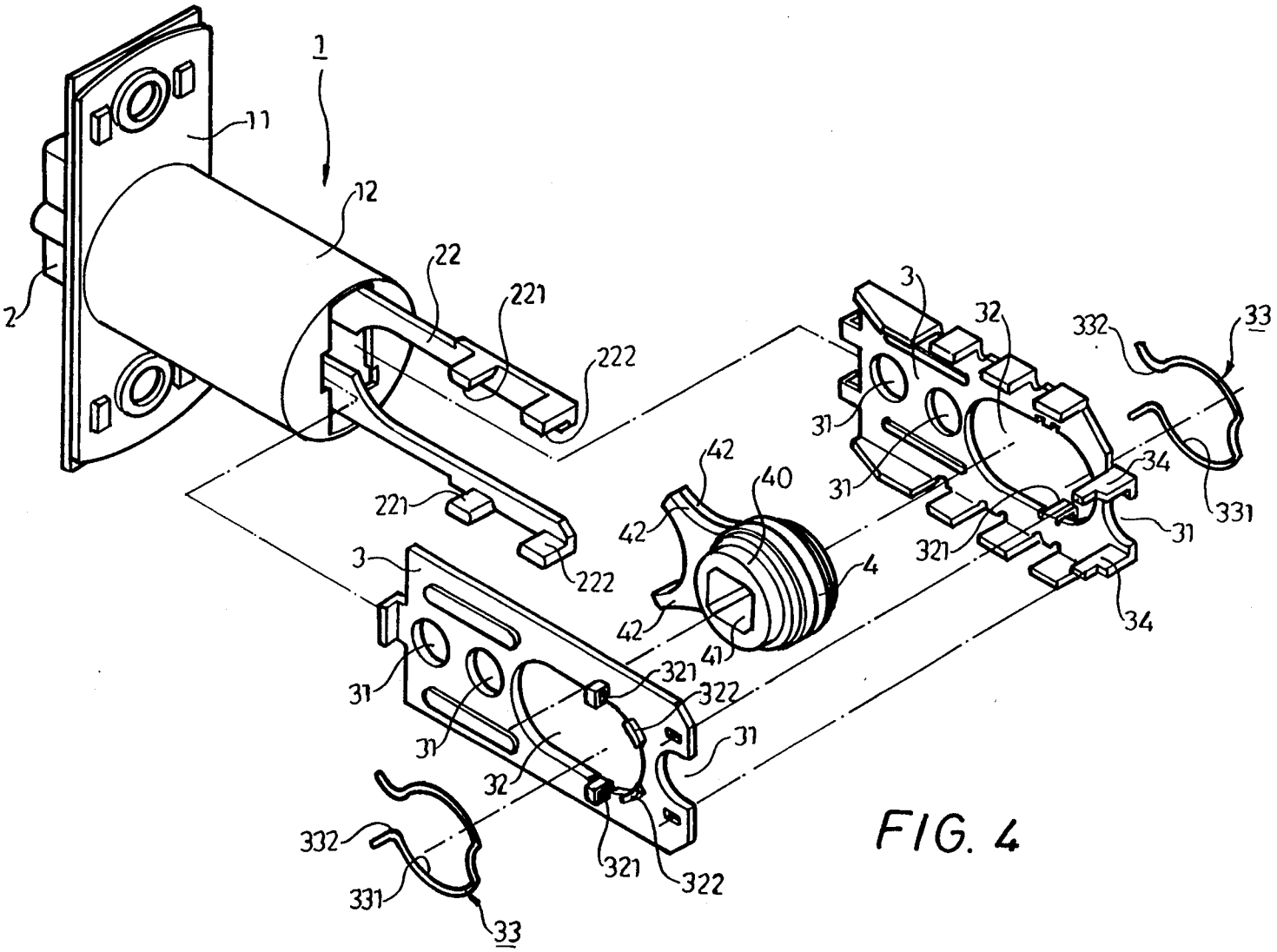
FIG. 4 is an exploded view in accordance with a second embodiment of the present invention.

Referring next to FIG. 4, illustrated is a third embodiment of the present invention which is almost identical to the embodiment as shown in FIGS. 1 to 3, except that a resilient member 35 of slightly different shape from the resilient member 33 is used, one of the plates 3 includes a pair of limbs 34 laterally extended therefrom for engagement with the other plate 3, the resilient member 35 includes two channels 36 for engagement with the limbs 34 of the plate 3 and has a throat portion 37 engageable with the actuating wheel 4 so as to position the actuating wheel 4.

It is to be noted that the oblong holes 32 are provided such that actuating wheel 4 may slide to either of the end portions of the oblong holes 32, this is particular appreciated for assembling the door locks having different sizes. However, the actuating wheel 4 is engaged on the square shaft of the door lock and can be stably retained in place by the square shaft, such that, without the resilient member 33, 35, the actuating wheel 4 can also be positioned. The resilient members 33, 35 are provided for further stably positioning the actuating wheel 4.

Figure 6:
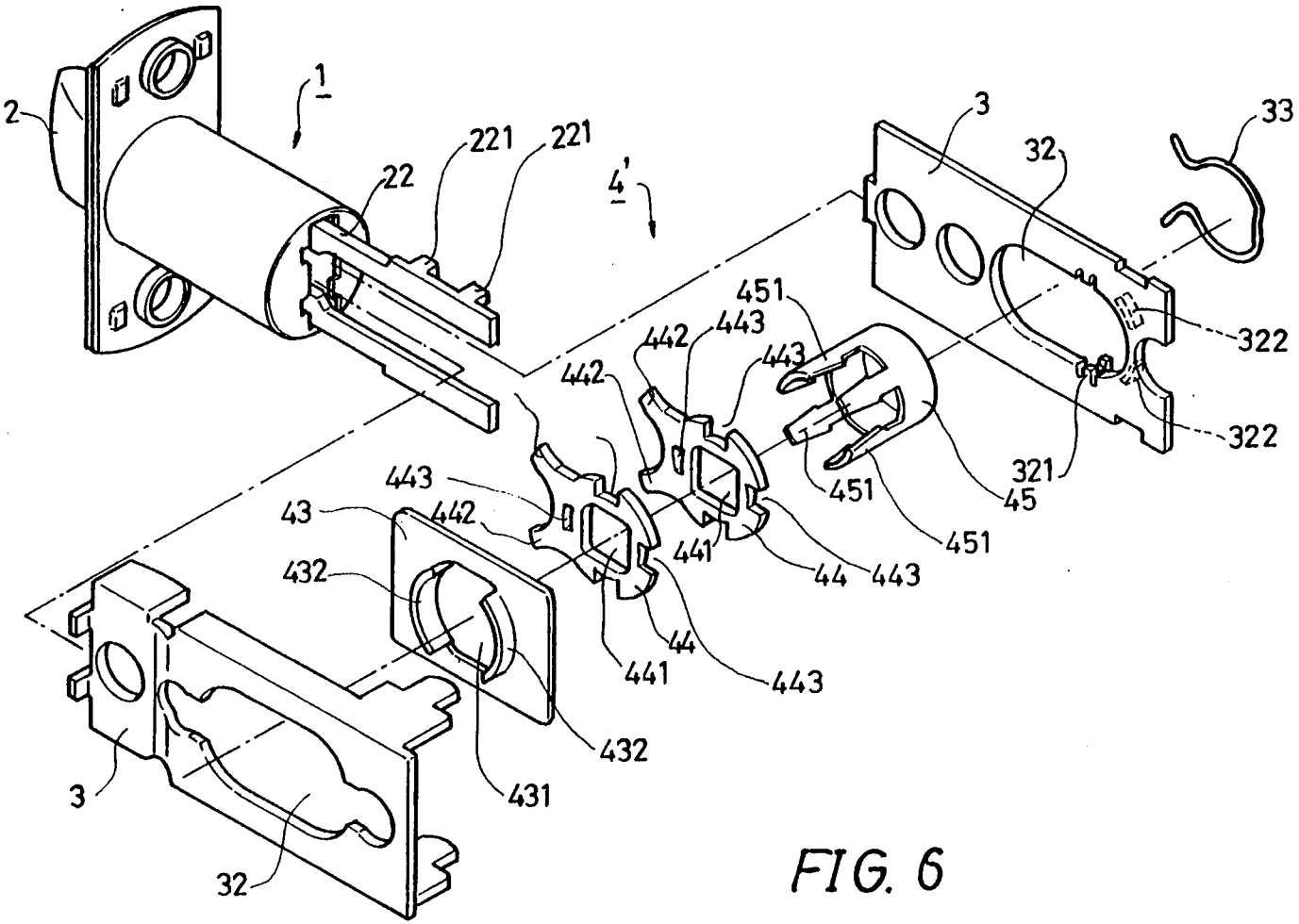
FIG. 6 is an exploded view in accordance with a fourth embodiment of the present invention.

Referring next to FIG. 6, illustrated is a fourth embodiment of the present invention which is almost identical to the embodiment as shown in FIGS. 1 to 3, except the actuating means 4' which is engageable with the dead bolt 2 for operating the dead bolt 2. The actuating means 4' includes two actuators 44 each including a plate shape having a square hole 441 formed therein and each having two pawls 442 for engaging with the protrusions 221, 222, and each having four notches 443 formed around the square hole 441, a barrel 45 slidably engaged in the openings 32 of the plates 3 and including four legs 451 for engaging with the notches 443 of the actuators 44 so that the barrel and the actuators 44 move in concert. A board 43 includes a puncture 431 engaged on the legs 451 of the barrel 45, and a pair of flanges 432 extended therefrom for engaging with the legs 451 of the barrel 45.

The spring 33 is provided to resiliently engage with the actuating means 4' so as to retain the actuating means 4' in different positions in the oblong holes 32, best shown in FIGS. 3 and 4. It is to be noted that the oblong holes 32 are provided such that actuating means 4' may slide to either of the end portions of the oblong holes 32, this is particular appreciated for assembling the door locks having different sizes. The actuating means 4' is engaged on the square shaft of the door lock and can be stably retained in place by the square shaft.

Figure 7:
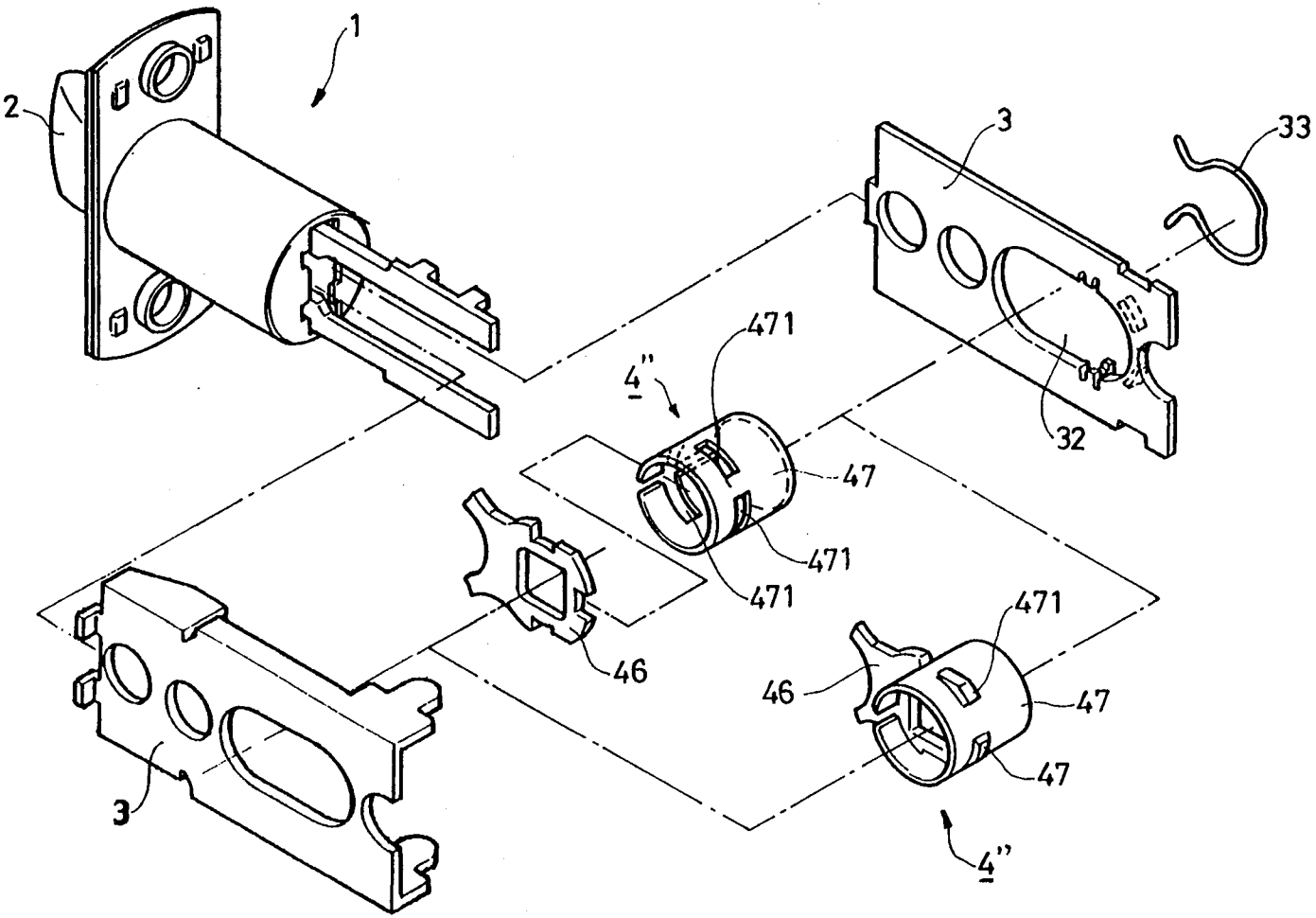
FIG. 7 is an exploded view in accordance with a fifth embodiment of the present invention.

Referring next to FIG. 7, illustrated is another embodiment of the actuating means 4'' which is almost identical to the embodiment as shown in FIG. 6 except the barrel 47, the barrel 47 includes a number of cavities 471 formed therein for receiving and positioning the actuator 46.

Accordingly, the dead bolt assembly for a tubular door lock has a simplified configuration which thus decreases the manufacturing cost thereof.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A dead bolt assembly comprising a lock case including a cylinder, a dead bolt slidably received in said cylinder and including a pair of extensions extended outward beyond said cylinder, each of said extensions including a pair of protrusions extended therefrom, a pair of plates fixed to said cylinder and each including an oblong hole formed therein, each of said oblong holes including two end portion, and a rotatable actuating means slidably engaged in said oblong holes of said plates and slidable between said end portions of said oblong holes and slidable between said extensions of said dead bolt, said actuating means comprising a cylindrical barrel and a pair of plate-shaped actuators engaged with the barrel, each actuator having a pair of projecting pawls for engagement with said protrusions of said extensions when said actuating means rotates and each actuator further including a central aperture for imparting rotation to the actuating means.

2. A dead bolt assembly according to claim 1 further comprising means for positioning said actuating means.

3. A dead bolt assembly according to claim 2, wherein said positioning means includes a resilient member fixed to a first plate of said plates, said resilient member includes a throat portion located in a middle portion of said oblong hole of said first plate for positioning said actuating means.

4. A dead bolt assembly according to claim 3, wherein said first plate includes a pair of hooks and a pair of stops formed thereon, said resilient member is engaged with and supported by said hooks and said stops.

5. A dead bolt assembly comprising a lock case, a dead bolt slidably received in said lock case and including a pair of extensions extended outward beyond said lock case, each of said extensions including a pair of protrusions extended therefrom, a pair of plates fixed to said case each including an oblong hole formed therein, each of said oblong holes including two end portions, two actuators each including two pawls for engaging with said protrusions of said dead bolt, a barrel engaged with said actuators for rotation in concert therewith and slidably engaged in said oblong holes of said plates and slidable between said end portions of said oblong holes and slidable between said extensions of said dead bolt, a spring fixed to a first plate of said pair of plates for engaging with said barrel so as to retain said barrel in place.

6. A dead bolt assembly according to claim 5, wherein said first plate includes a pair of hooks and a pair of stops formed thereon, said spring is engaged with and supported by said hooks and said stops of said first plate.

7. A dead bolt assembly according to claim 5, wherein each of said actuators includes at least three notches formed therein, said barrel includes at least three legs extended therefrom and engaged with said notches of said actuators.

8. A dead bolt assembly according to claim 7 further comprising a board including a puncture formed therein engaged with said legs of said barrel, said board includes a pair of flanges extended therefrom and engaged with said barrel.

* * * * *